US010145186B2

(12) United States Patent
Fuehring et al.

(10) Patent No.: US 10,145,186 B2
(45) Date of Patent: Dec. 4, 2018

(54) LOW MARKING INSERTS FOR CASING/TUBING TONGS

(71) Applicant: Weatherford Technology Holdings, LLC, Houston, TX (US)

(72) Inventors: Ernst Fuehring, Lindhorst (DE); Thomas Reinecke, Hannover (DE); Bjoern Thiemann, Burgwedel (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/349,665

(22) Filed: Nov. 11, 2016

(65) Prior Publication Data

US 2018/0135361 A1 May 17, 2018

(51) Int. Cl.
*E21B 19/06* (2006.01)
*E21B 19/10* (2006.01)

(52) U.S. Cl.
CPC ..... *E21B 19/06* (2013.01); *E21B 19/10* (2013.01)

(58) Field of Classification Search
CPC . B66C 1/00; E21B 19/07; E21B 19/06; E21B 41/00; E21B 41/0021; E21B 19/10
See application file for complete search history.

(56) References Cited

U.S. PATENT DOCUMENTS 1,719,533 A * 7/1929 Cady ..... E21B 19/10 175/423
1,834,316 A 12/1931 McLagan
1,836,680 A * 12/1931 Nixon ..... E21B 19/10 175/423
2,962,919 A * 12/1960 Grundmann ..... E21B 19/10 269/237
3,513,511 A * 5/1970 Crickmer ..... E21B 19/10 175/423
3,538,561 A * 11/1970 Margarit ..... E21B 19/10 175/423
5,451,084 A 9/1995 Jansch
5,971,086 A 10/1999 Bee et al.
6,079,509 A 6/2000 Bee et al.
6,971,283 B2 12/2005 Belik
7,125,195 B2 10/2006 Hagen
7,231,984 B2 * 6/2007 Jaensch ..... B25B 13/5016 166/380
2008/0196556 A1 8/2008 Belik

FOREIGN PATENT DOCUMENTS

EP 0656986 A1 6/1995

OTHER PUBLICATIONS

PCT International Search Report and Written Opinion dated Dec. 14, 2017, for International Application No. PCT/US2017/058024.

* cited by examiner

*Primary Examiner* — Stephen A Vu
(74) *Attorney, Agent, or Firm* — Patterson & Sheridan, L.L.P.

(57) ABSTRACT

Embodiments of the present disclosure generally relate to an insert in a clamping device or gripping apparatus. The insert may include a gripping element having an elongated body and a plurality of contact features, a first member formed from a hard material, wherein the first member contacts the gripping element in one or more locations, and a second member formed from an elastic material, wherein the second member contacts the gripping element along the elongated body.

7 Claims, 18 Drawing Sheets

LOW MARKING INSERTS FOR CASING/TUBING TONGS

BACKGROUND

Field

Embodiments of the present disclosure relate to a clamping device or gripping apparatus used to translate forces and/or torque in the field of oil and gas exploration. Particularly, embodiments of the present disclosure relate to an insert in a clamping device or gripping apparatus.

Description of the Related Art

In conventional well completion operations, a wellbore is formed to access hydrocarbon-bearing formations by the use of drilling. To drill within the wellbore to a predetermined depth, a drill string having a cutting structure attached to a lower end is often rotated by a top drive or rotary table. After drilling to a predetermined depth, the drill string and drill bit are removed and a section of casing is lowered into the well bore.

During oil and gas operations, such as conventional drilling, drilling with casing operation, casing, cementing, and pressure control, drill strings, pipes, and casings, may be held, torqued, and/or translated by clamping devices or gripping apparatus, such as tongs, spiders, elevators, and gripping heads such as torque heads and spears during different stages of a well completion or other wellbore operation. Clamping devices and gripping apparatus may hold pipes, tubulars, drill strings, or casings using jaws. The jaws may have interchangeable inserts to conduct translational forces and/or torques into corresponding moveable objects. Such an insert typically includes a base material and gripping elements. Each gripping element has an object gripping surface to engage the corresponding object in order to lift, shift, or rotate the object. In particular, for rotation of the object, considerable clamping or gripping forces are necessary to transmit torque. However, when torque is present, the gripping elements may start to tilt significantly resulting in slippage. Additionally, inserts may be contaminated and/or clogged. Contamination and/or clogging may result in insufficient penetration on the gripping surfaces leading to slippage.

Therefore, there is a need for improved insert for gripping device for transfer torque without the risk of slippage.

SUMMARY

Embodiments of the present disclosure generally relate to an insert in a clamping device or gripping apparatus.

One embodiment of the present disclosure provides an insert for a tubular handling tool. The insert includes a gripping element having an elongated body and a plurality of contact features, a first member formed from a hard material, wherein the first member contacts the gripping element in one or more locations, and a second member formed from an elastic material, wherein the second member contacts the gripping element along the elongated body.

Another embodiment of the present disclosure provides an insert for a tubular handling tool. The insert includes a gripping element having an elongated body and a plurality of contact features, a first member formed from a hard material, wherein the first member contacts the gripping element in one or more locations, and a second member formed from an elastic material, wherein the second member contacts the gripping element along the elongated body.

Another embodiment of the present disclosure provides a gripping element. The gripping element includes an elongated body having a blade edge, wherein the blade edge includes a plurality of contact features, wherein each contact feature is symmetrical about a central line of the contact feature, and a plurality of valleys, wherein a valley is disposed between neighboring contact features.

BRIEF DESCRIPTION OF THE DRAWINGS

So that the manner in which the above recited features of the present disclosure can be understood in detail, a more particular description of the various aspects, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
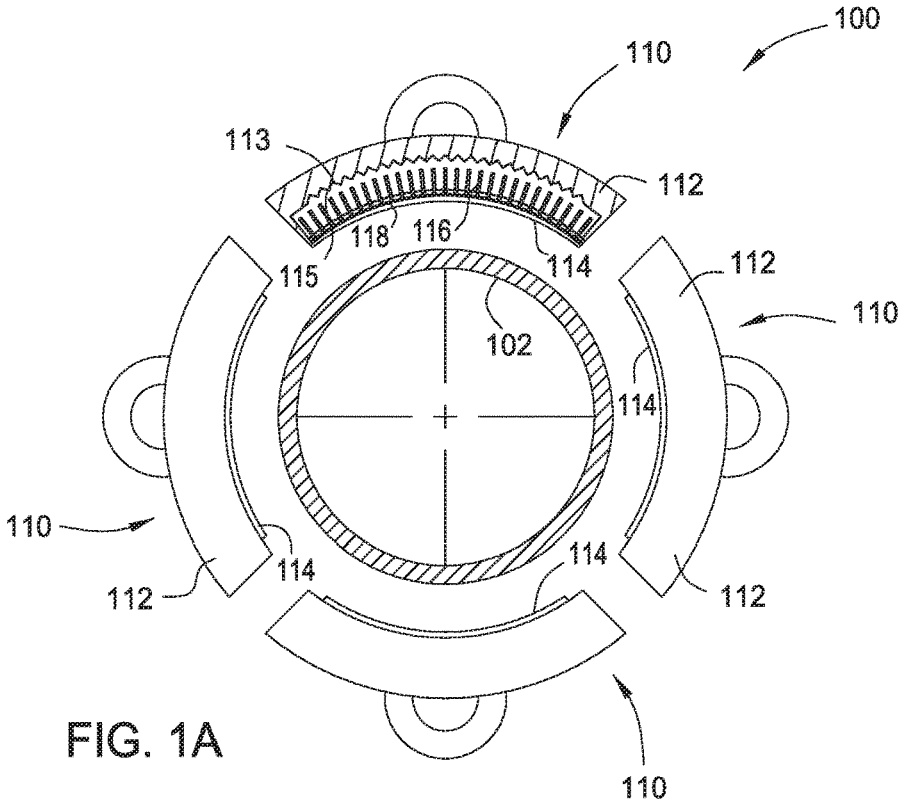
FIG. 1A is schematic top view of a gripping device having inserts according to one embodiment of the present disclosure.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Figure 1B:
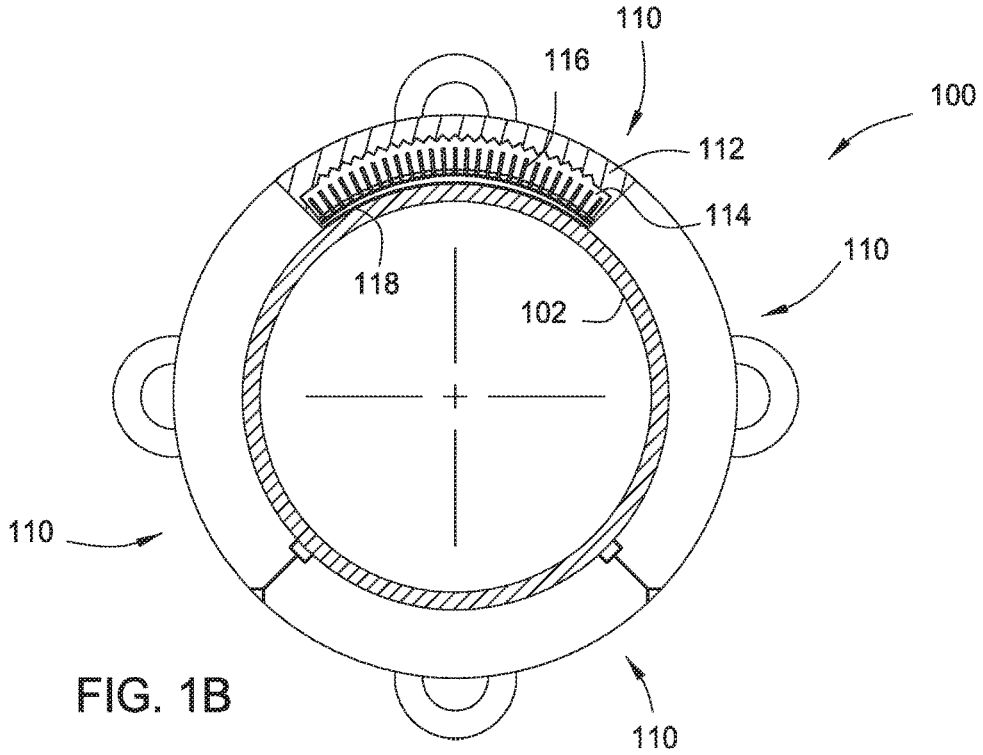
FIG. 1B is a schematic top view of the gripping device of FIG. 1A in a gripping position.

FIG. 1A is schematic top view of a gripping device 100 having inserts according to one embodiment of the present disclosure. FIG. 1B is a schematic top view of the gripping device 100 of FIG. 1A in a gripping position. The gripping device 100 may be tongs, spiders, elevators, and gripping heads such as torque heads and spears. The gripping device 100 includes two or more jaws 110. Each jaw 110 includes an insert 114 for holding a movable object, such as a tubular 102. The inserts 114 from two or more jaws 110 may be arranged in a circular manner surrounding the object.

Each jaw 110 may include a frame 112 for receiving the insert 114. In one embodiment, the frame 112 may include a ribbed surface 113 matching a ribbed surface 115 of the insert 114. The ribbed surfaces 113, 115 allow the insert 114 to slide into the frame 112 while preventing the insert 114 from rotating relative to the frame 112 when a torque is applied to the insert 114. Each insert 114 may include a plurality of gripping elements 116 for contacting the object, such as the tubular 102. The plurality of gripping elements 116 are arranged to form a gripping surface 118 to interact with tubular 102. In one embodiment, the gripping surface 118 may be a section of a cylindrical surface having a diameter substantially similar to an outer diameter of the tubular 102. In one embodiment, inserts of different dimensions and/or shapes may be interchangeably installed in the jaws 110 to grip objects of different diameters and/or shapes.

The jaws 110 may be movable relative to each other to grip and release the tubular 102. Each jaw 110 may be linearly movable along a radial direction. Alternatively, the jaws 110 may pivot relative to each other to release and grip an object. FIG. 1A illustrates the gripping device 100 when the jaws 110 are in a released position. FIG. 1B illustrates the gripping device 100 when the jaws 110 are in a gripping position. According to embodiments of the present disclosure, the gripping elements 116 may be arranged with improved rigidity under applied torque in the gripping position.

Figure 2A:
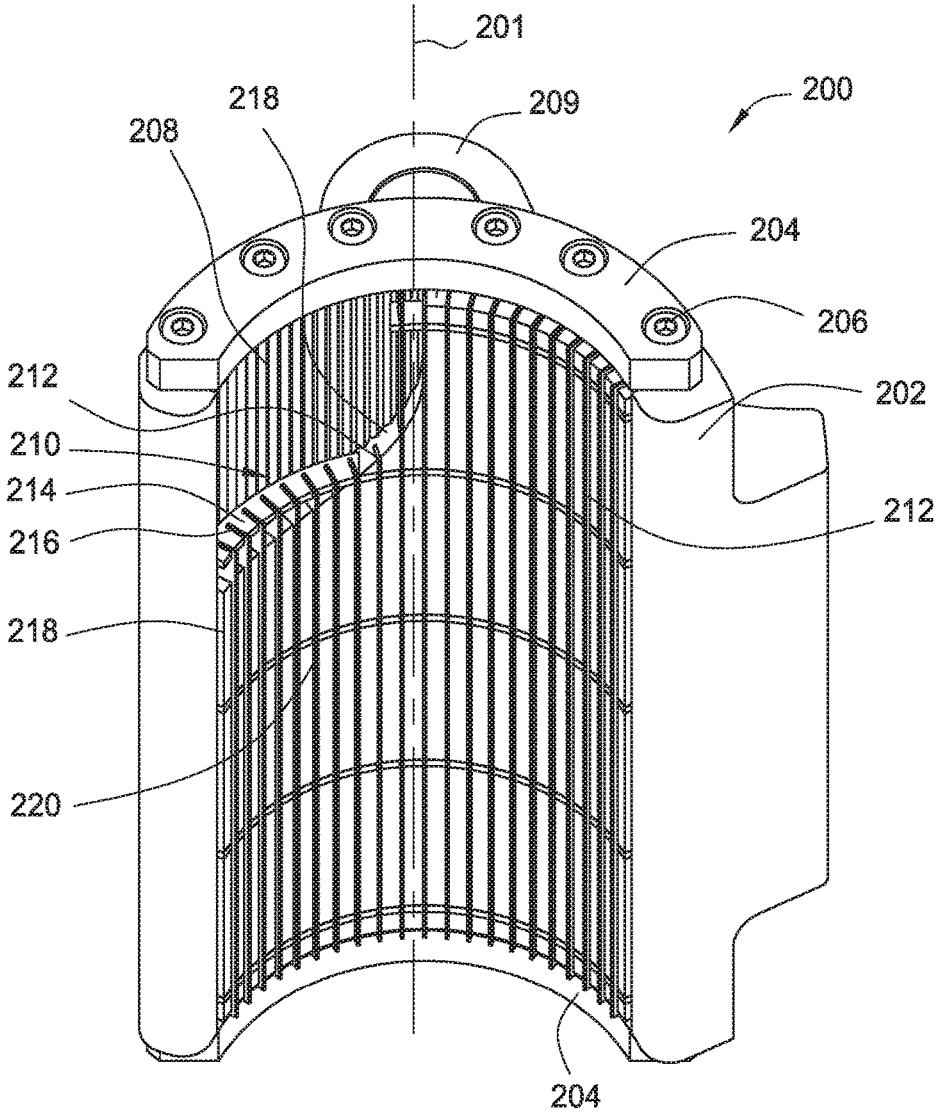
FIG. 2A is a schematic perspective view of a jaw according to one embodiment of the present disclosure.

FIG. 2A is a schematic perspective view of a jaw 200 according to one embodiment of the present disclosure. The jaw 200 may be used as the jaws 110 in the gripping device 100. The jaw 200 may include a frame body 202 and ends 204. The frame body 202 and ends 204 form a cavity for receiving an insert 210 therein. At least one end 204 may be movably attached to the frame body 202. As shown in FIG. 2A, the end 204 may be connected to the frame body 202 by connectors 206, such as screws. The end 204 may be removed from the frame body 202 to install or remove the insert 210 from the frame body 202. The frame body 202 and the ends 204 may be made from a rigid material, such as a metal. In one embodiment, the jaw 200 may include a handle 209 for connection with an actuator configured to move the jaw 200.

The frame body 202 may include a patterned surface 208 for receiving and securing the insert 210 in place. In the embodiment of FIG. 2A, the patterned surface 208 may be a ribbed surface having a plurality of ribs along a longitudinal axis 201. The ribs allow the insert 210 to be installed in the cavity when the end 204 is removed. During operation, the ribs also prevent the insert 210 from rotating relative to the frame body 202, particularly when the insert 210 is subject to a torque. Alternatively, the patterned surface 208 may have any suitable pattern. The end 204 may be replaced on the frame body 202 after the insert 210 is installed to secure the insert 210 in the frame body 202.

The insert 210 may include a plurality of gripping elements 212. FIG. 2B is a schematic side view of the gripping element 212. Each gripping element 212 may include a body 221 having a plurality of contact features 220 along a top edge for gripping an object. In one embodiment, the contact features 220 may be teeth. Alternatively, the contact features 220 may be grains or particles. The gripping elements 212 may be formed from a hard material, such as a metal. The body 221 may be substantially linear. The plurality of gripping elements 212 may be arranged parallel to the longitudinal axis 201 of the jaw 200.

Figure 2C:
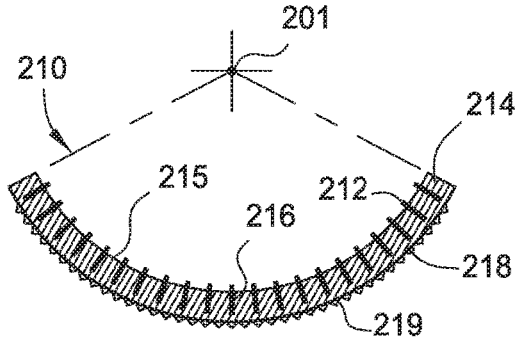
FIG. 2C is a schematic sectional view of an insert in the jaw of FIG. 2A.
Figure 2B:
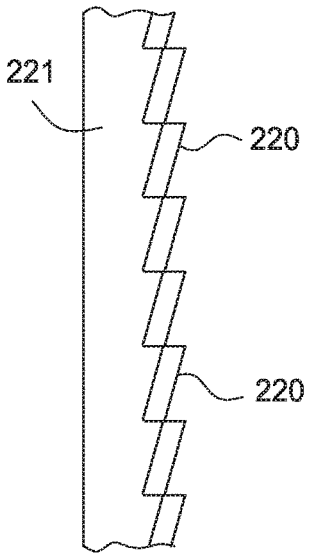
FIG. 2B is a schematic side view of a gripping element according to one embodiment of the present disclosure.
Figure 2D:
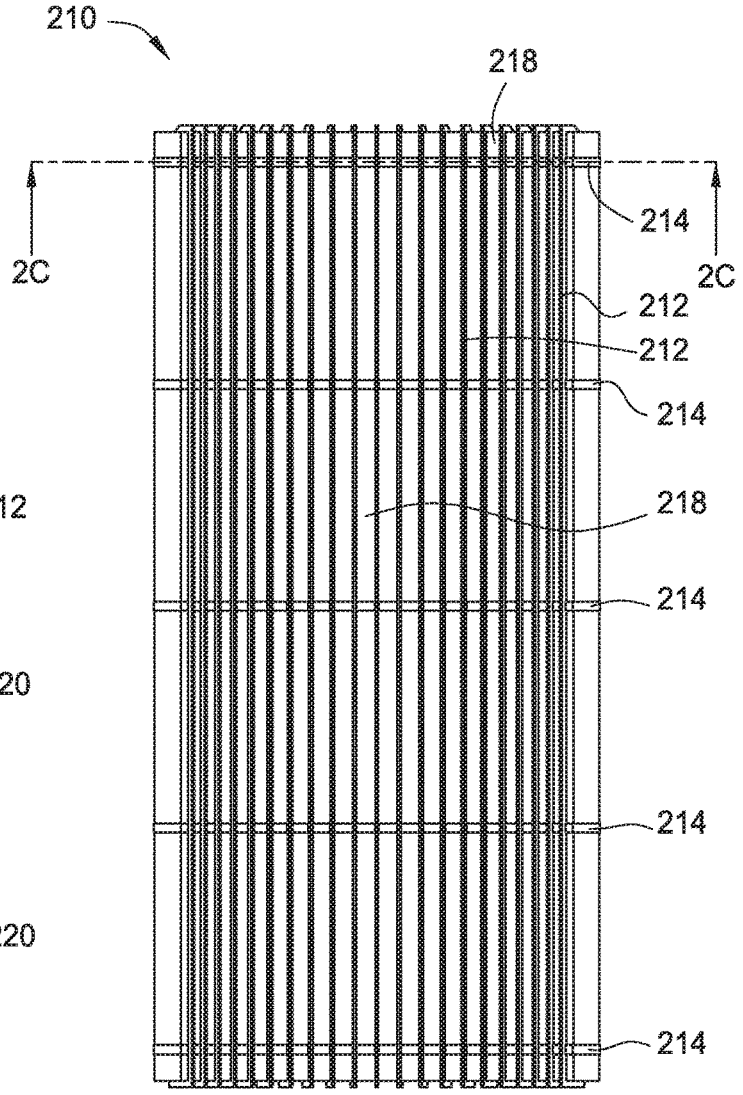
FIG. 2D is a schematic side view of the insert of FIG. 2C.

FIG. 2C is a schematic sectional view of the insert 210 in the jaw 200. FIG. 2D is a schematic side view of the insert 210. The insert 210 may further include one or more braces 214 for holding the plurality of gripping elements 212. Each brace 214 may be a rigid plate having a plurality of slots 216. Each slot 216 may hold one gripping element 212 therein. As shown in FIG. 2C, the brace 214 may be a section of a ring shaped plate having an inner curve 215. The inner curve 215 may be a section of a circle. The plurality of slots 216 may be arranged along the ring shaped plate at directions normal to the inner curve 215. The insert 210 may include at least two braces 214 positioned at different longitudinal positions of the plurality of gripping elements 212. In one embodiment, the plurality of slots 216 may be evenly distributed along the brace 214. Alternatively, the plurality of slots 216 may be arranged at a varied pitch along the inner curve 215. The braces 214 may be formed from a hard material, such as a metal. The braces 214 hold the gripping elements 212 within the slots 216 to prevent the gripping elements 212 from deflection during operation, for example when a torque is applied to the gripping elements 212.

The plurality of gripping elements 212 and the one or more braces 214 may be disposed in a base 218. In one embodiment, the base 218 may include a patterned surface 219 matching the patterned surface 208 of the frame body 202. The patterned surface 219 nests with the patterned surface 208 preventing the insert 210 from moving relative to the frame body 202. In one embodiment, the patterned surface 219 may include a plurality of ribs along the longitudinal axis 201.

The base 218 may be fabricated from a material that has a predetermined elasticity. The elasticity of the base 218 provides flexibility to the gripping elements 212 to enable an even load distribution among the gripping elements 212 and/or along a length of each gripping element 212. The elasticity of the base 218 enables a full surface-to-surface contact between the gripping elements 212 and the object being handled particularly when the object being handled has irregular or uneven outer surface. In one embodiment, the base 218 may be an elastomer, for example a synthetic rubber, such as nitrile butadiene rubber (NBR). In another embodiment, the base 218 may be formed from a soft metal, such as aluminum.

Figure 3A:
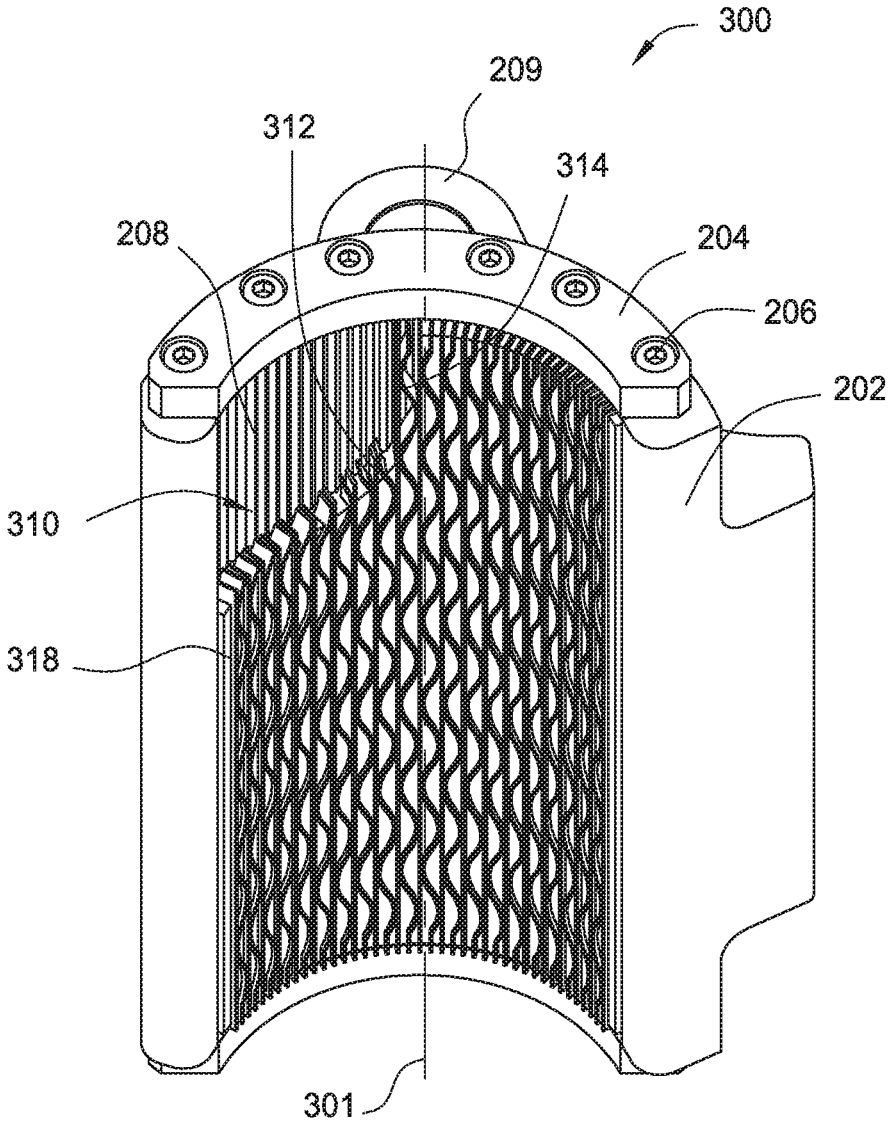
FIG. 3A is a schematic perspective view of a jaw according to another embodiment of the present disclosure.

FIG. 3A is a schematic perspective view of a jaw 300 according to another embodiment of the present disclosure. The jaw 300 may be used as the jaws 110 in the gripping device 100. The jaw 300 is similar to the jaw 200 in FIG. 2A except that the jaw 300 includes an insert 310 with a different gripping element arrangement.

Figure 3C:
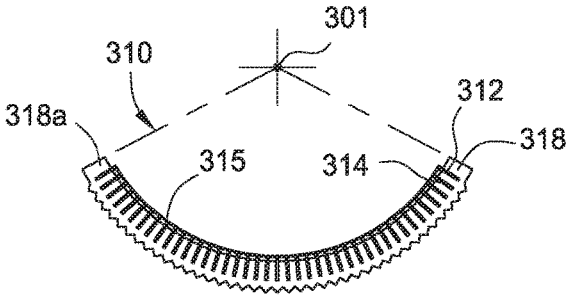
FIG. 3C is a schematic top view of the insert of FIG. 3B.
Figure 3F:
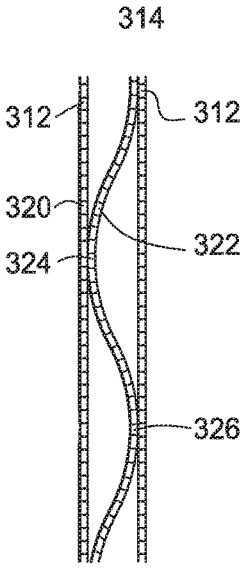
FIG. 3F is a partial enlarged view of the insert of FIG. 3B.
Figure 3B:
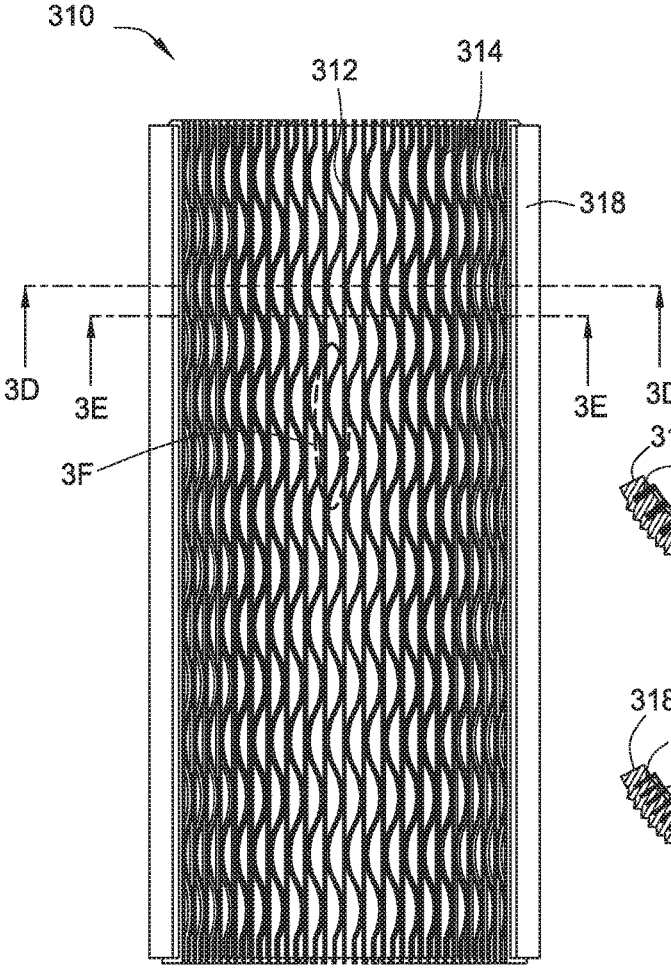
FIG. 3B is a schematic side view of an insert in the jaw of FIG. 3A.
Figure 3D:
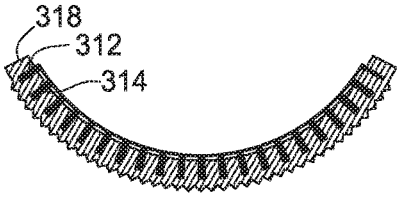
FIGS. 3D and 3E are schematic sectional views of the insert of FIG. 3B.
Figure 3E:
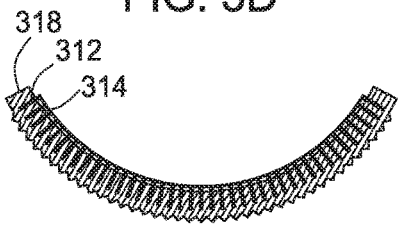

FIG. 3B is a schematic side view of the insert 310. FIG. 3C is a schematic top view of the insert 310. FIGS. 3D and 3E are schematic sectional views of the insert 310. The insert 310 may include a plurality of planar gripping elements 312 and a plurality of non-planar gripping elements 314 disposed in a base 318. The planar gripping elements 312 may be similar to the gripping element 212 of FIG. 2B. The planar gripping element 312 may include a planar blade body having contact features 320 formed along a top edge that is substantially linear. The non-planar gripping elements 314 may include a non-planar blade body having contact features 322 formed along a top edge that is substantially non-linear. The non-planar blade body may be a wavy body having repeating peaks and valleys. The non-planar gripping elements 314 shown in FIG. 3B have a sine waveform. Alternatively, the planar gripping elements 314 may have other wave forms, such as saw-tooth waveforms, triangle waveforms, square waveforms, or the like.

The base 318 may be a section of a tubular and fabricated from a material that has a predetermined elasticity. In one embodiment, the base 318 may be an elastomer, for example a synthetic rubber, such as nitrile butadiene rubber (NBR). In another embodiment, the base 318 may be formed from a soft metal, such as aluminum. The gripping elements 312 and 314 are disposed in the base 318 with the blade bodies substantially normal to an inner surface 318*a* of the base 318. The contact features 320 and 322 form a contact surface 315 that is substantially cylindrical.

The elasticity of the base 318 provides flexibility to the gripping elements 312, 314 to enable an even load distribution among the gripping elements 312, 314 and/or along a length of each gripping element 312, 314. The elasticity of the base 318 enables a full surface-to-surface contact between the gripping elements 312, 314 and the object being handled particularly when the object being handled has irregular or uneven outer surface. For example, tubulars may typically have a dimensional tolerance of +/−1%, which result in irregularities on outer surfaces.

The planar gripping elements 312 may be arranged parallel to a longitudinal axis 301 of the jaw 300 in the base 318. A non-planar gripping element 314 may be disposed between neighboring planar gripping elements 312. The non-planar gripping element 314 touches the planar gripping elements 312 at both sides and provides support to the planar gripping elements 312, preventing the planar gripping elements 312 from deflection under applied force and/or torque. Similarly, the planar gripping elements 312 on both sides of the non-planar gripping element 314 also touch and support the non-planar gripping element 314, preventing the non-planar gripping element 314 from defection under applied force and/or torque.

FIG. 3F is a partial enlarged view of the insert 310 showing contact between the planar gripping elements 312 and the non-planar gripping elements 314. The non-planar gripping element 314 may include peaks 324 and valleys 326 that contact adjacent planar gripping elements 312. In one embodiment, the peaks 324 and valleys 326 may be periodical. The peaks 324 and valleys 326 on the plurality of non-planar gripping elements 314 may be substantially synchronized in phase along the longitudinal axis 301 to provide a symmetrical pattern. Alternatively, the non-planar gripping elements 314 may not be synchronized in phase. Alternatively, the non-planar gripping elements 314 may have peaks 324 and valleys 326 of different wavelengths to form a different pattern to obtain a different load distribution effect.

As shown in FIG. 3F, the contact features 322 on the non-planar gripping element 314 have different orientations thus providing different penetrating angles when contacting the object being gripped. The different penetration angles of the contact features 322 provide support at different angles, therefore, facilitating even load distribution.

Figure 4A:
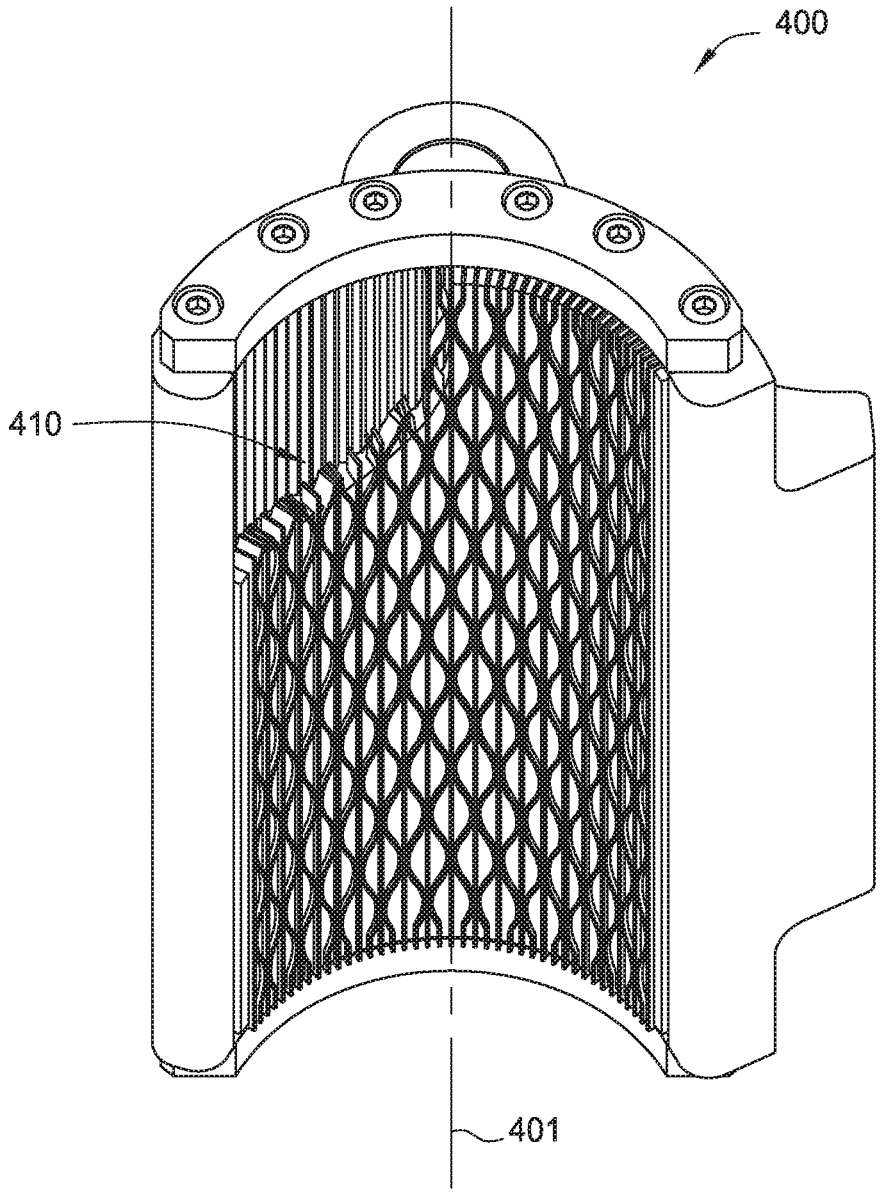
FIG. 4A is a schematic perspective view of a jaw according to another embodiment of the present disclosure.

FIG. 4A is a schematic perspective view of a jaw 400 according to another embodiment of the present disclosure. The jaw 400 may be used as the jaws 110 in the gripping device 100. The jaw 400 is similar to the jaw 300 in FIG. 3A except that the jaw 400 includes an insert 410 with a different gripping element arrangement.

Figure 4C:
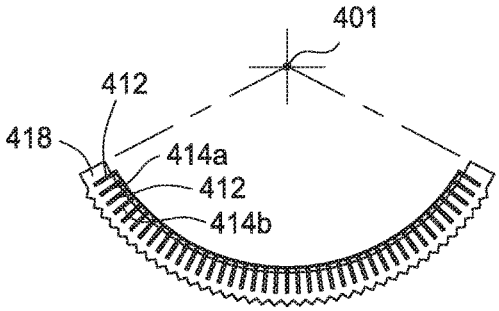
FIG. 4C is a schematic top view of the insert of FIG. 3B.
Figure 4B:
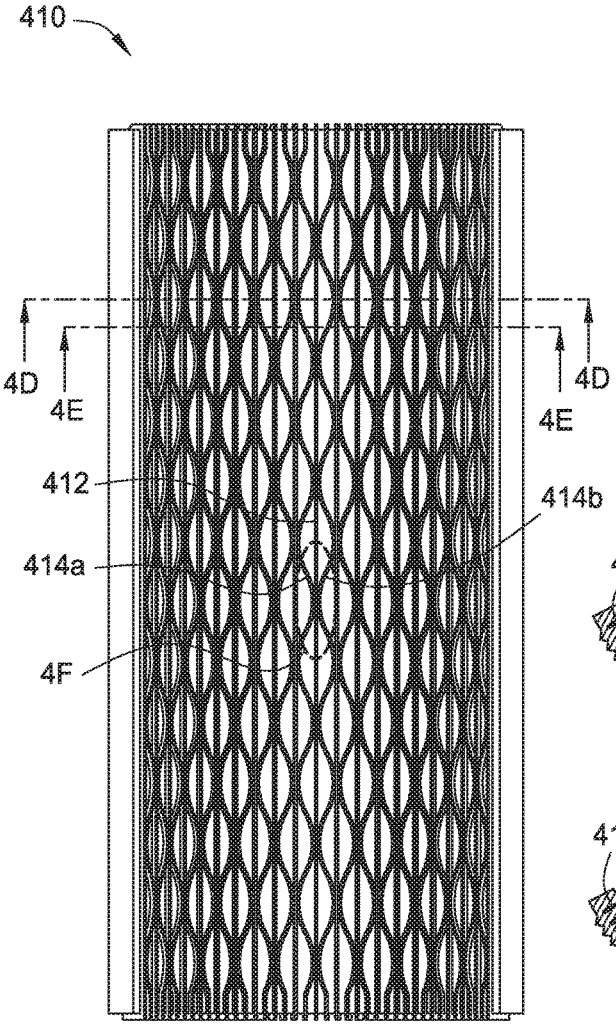
FIG. 4B is a schematic side view of an insert in the jaw of FIG. 4A.

FIG. 4B is a schematic side view of the insert 410. FIG. 4C is a schematic top view of the insert 410. FIGS. 3D and 3E are schematic sectional views of the insert 410. The insert 410 may include a plurality of planar gripping elements 412 and a plurality of non-planar gripping elements 414*a* and 414*b* disposed in a base 418. The planar gripping elements 412 may be similar to the planar gripping element 312 of FIG. 3B. The non-planar gripping elements 414*a*, 414*b* are similar to the non-planar gripping element 314 of FIG. 3B. The base 418 is similar to the base 318 of FIG. 3B.

The planar gripping elements 412 may be arranged parallel to a longitudinal axis 401 of the jaw 400 in the base 418. A non-planar gripping element 414*a* or a non-planar gripping element 414*b* is alternately disposed in the space between neighboring planar gripping elements 412. The non-planar gripping element 414*a*, 414*b* touches the planar gripping elements 412 at both sides and provides support to the planar gripping elements 412, preventing the planar gripping elements 412 from deflection under applied force and/or torque. Similarly, the planar gripping elements 412 on both sides of the non-planar gripping element 414*a*, 414*b* also touch and support the non-planar gripping element 414*a*, 414*b*, preventing the non-planar gripping element 414*a*, 414*b* from defection under applied force and/or torque.

Figure 4F:
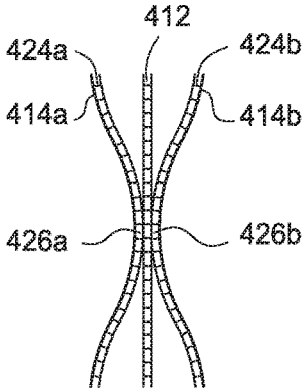
FIG. 4F is a partial enlarged view of the insert of FIG. 4B.
Figure 4D:
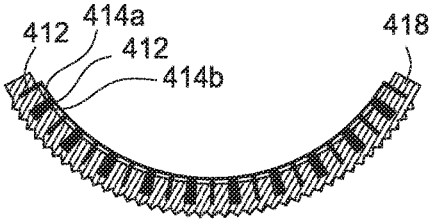
FIGS. 4D and 4E are schematic sectional views of the insert of FIG. 4B.
Figure 4E:
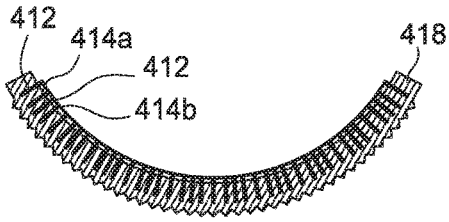

The non-planar gripping elements 414*a*, 414*b* on the opposite sides of a planar gripping element 412 are arranged in symmetry about the planar gripping element 412. FIG. 4F is a partial enlarged view of the insert 410 showing contact between the planar gripping elements 412 and the non-planar gripping elements 414*a*, 414*b*. Peaks 426*a*, 426*b* of the non-planar gripping elements 414*a*, 414*b* contact the planar gripping element 412 at opposite sides of the same location, reinforcing the upright position of the planar gripping element 412 and increasing the resistance against deflection under an applied force and/or torque. Contact features 424*a*, 424*b* on the non-planar gripping elements 414*a*, 414*b* also vary in direction, therefore, improving evenly load distribution.

Figure 5A:
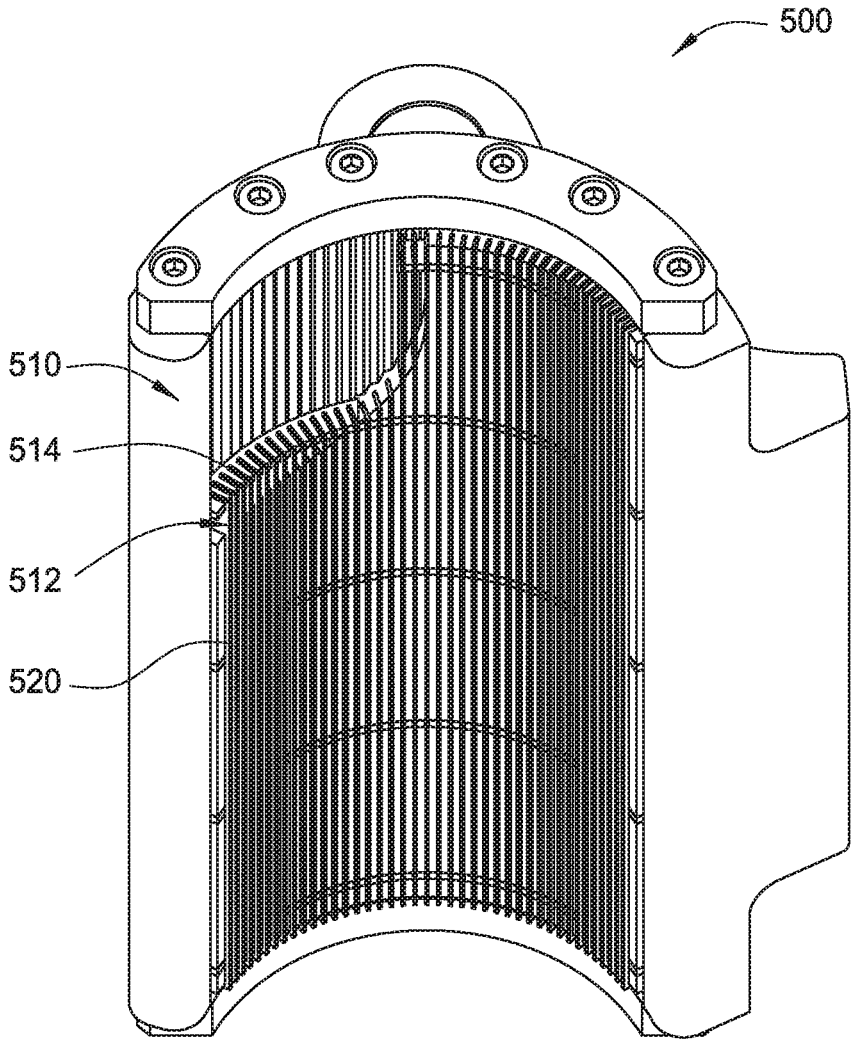
FIG. 5A is a schematic perspective view of a jaw according to one embodiment of the present disclosure.
Figure 5C:
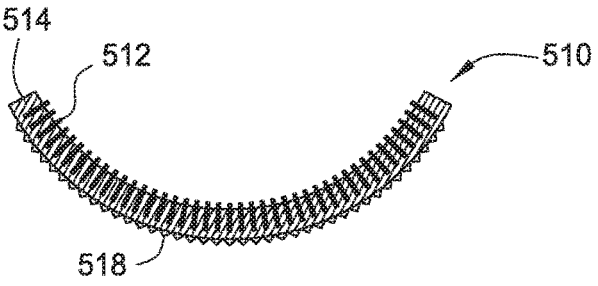
FIG. 5C is a schematic sectional view of the insert of FIG. 5B.
Figure 5B:
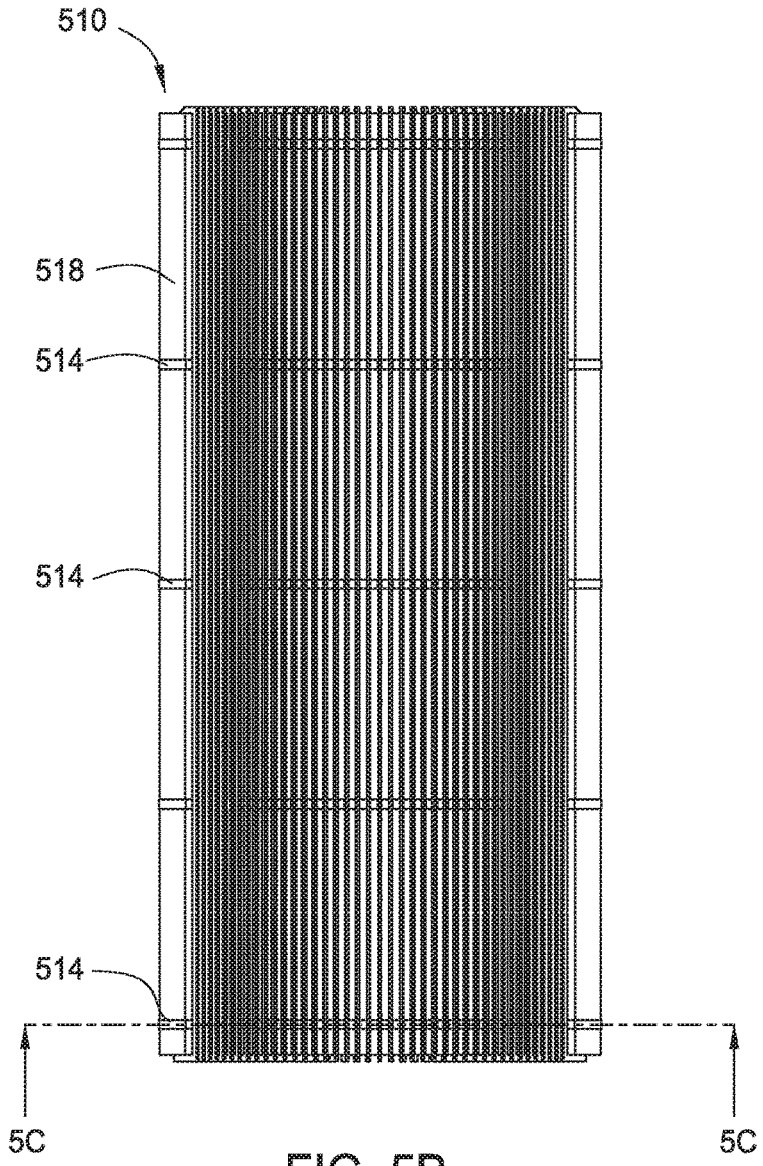
FIG. 5B is a schematic side view of an insert in the jaw of FIG. 5A.

FIG. 5A is a schematic perspective view of a jaw 500 according to one embodiment of the present disclosure. FIG. 5B is a schematic side view of an insert 510 in the jaw 500. FIG. 5C is a schematic sectional view of the insert 510. The jaw 500 may be used as the jaws 110 in the gripping device 100.

Similar to the insert 210 in FIG. 2A, the insert 510 includes a plurality of planar gripping elements 512 arranged parallel to a longitudinal axis of the insert 510 and within slots of two or more braces 514 and disposed in a base 518. However, the planar gripping elements 512 are placed in a higher density than the gripping element 212 in the insert 210. Each planar gripping element 512 includes more number of contact features 520 than the number of contact features 220 in each gripping element 212. The contact features 520 are a smaller in dimension than the contact features 220 on the gripping element 212. For example, when the contact features 520, 220 are teeth, the contact features 520 have a smaller depth than the contact features 220. Compared with the insert 210, the insert 510 has reduced penetration depth because of there are more contact features that are smaller in dimension. Inserts 510 and 210 may be used in situations when different penetration depth is desired.

Figure 6A:
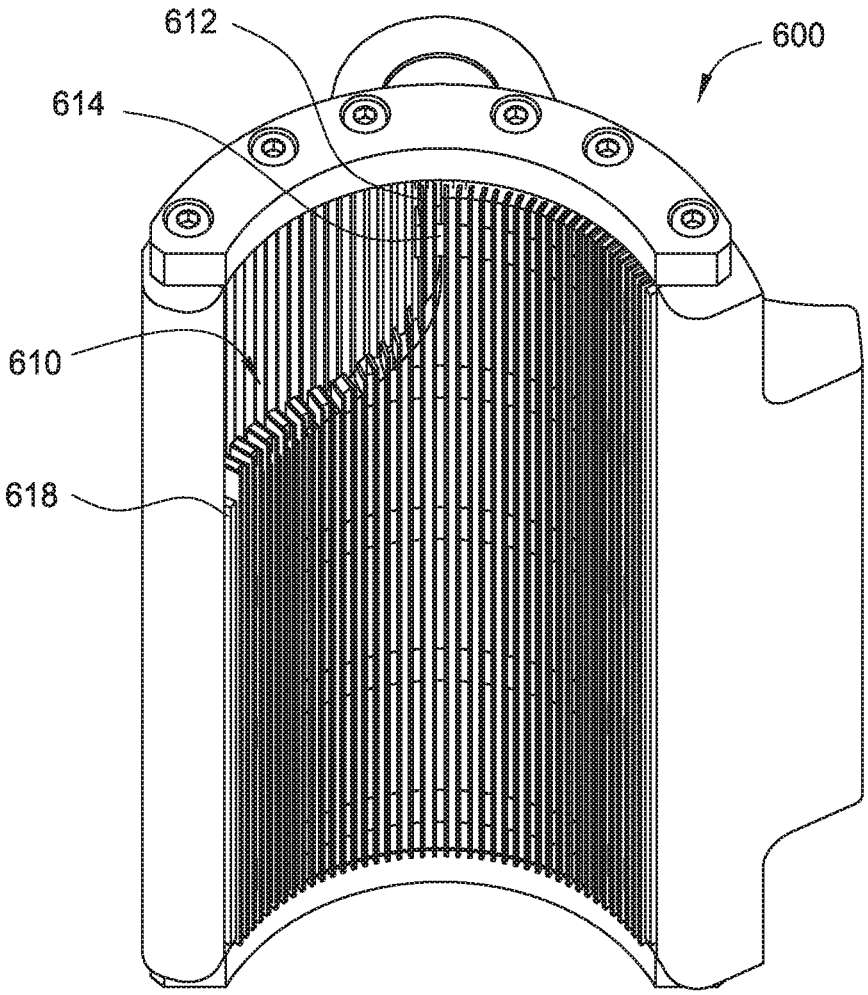
FIG. 6A is a schematic perspective view of a jaw according to one embodiment of the present disclosure.
Figure 6C:
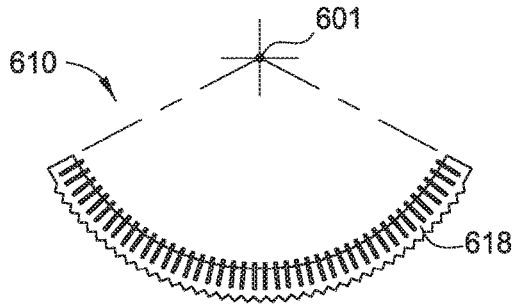
FIG. 6C is a schematic top view of the insert of FIG. 6B.
Figure 6D:
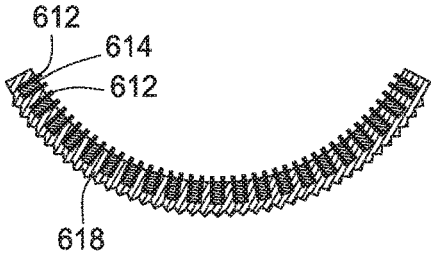
FIG. 6D is a schematic sectional view of the insert of FIG. 6B.
Figure 6B:
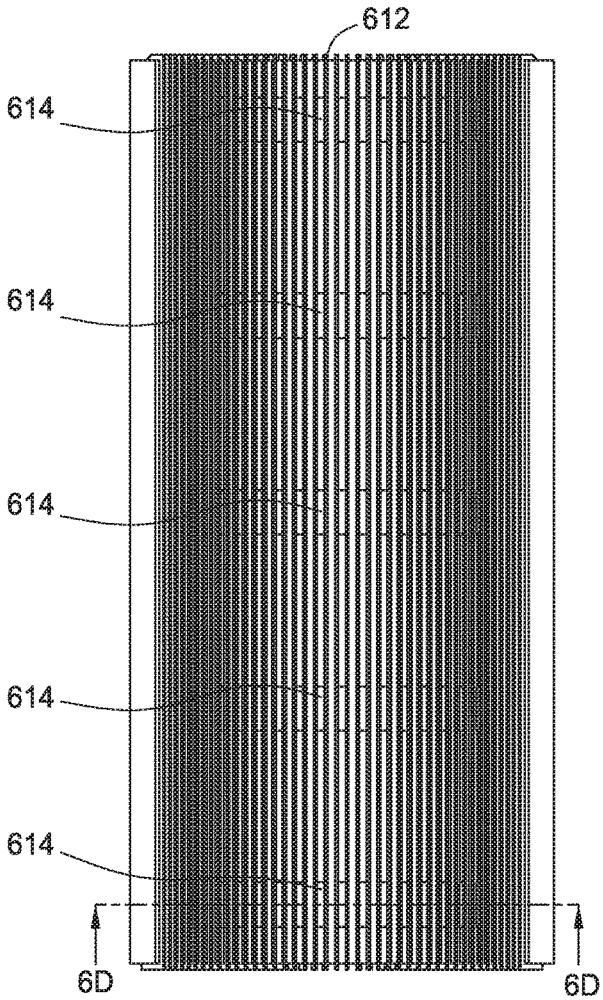
FIG. 6B is a schematic side view of an insert in the jaw of FIG. 6A.

FIG. 6A is a schematic perspective view of a jaw 600 according to one embodiment of the present disclosure. The jaw 600 may be used as the jaws 110 in the gripping device 100. The jaw 600 is similar to the jaw 200 except the jaw 600 has a different insert. FIG. 6B is a schematic side view of an insert 610 in the jaw 600. FIG. 6C is a schematic top view of the insert 610. FIG. 6D is a schematic sectional view of the insert 610.

The insert 610 may include a plurality of gripping elements 612. In one embodiment, the gripping elements 612 may be planar gripping elements 612 similar to the gripping element 212 of FIG. 2B. The gripping elements 612 may be disposed parallel to a longitudinal axis 601. The plurality of gripping elements 612 may be selectively disposed between neighboring gripping elements 612. For example, one or more spacers 614 may be disposed between a pair of gripping elements 612. The pair of gripping elements 612 and the spacers 614 form a unit having a width larger than a single gripping element. The larger width prevents the gripping elements 612 from deflecting. In one embodiment, two or more rows of spacers 614 may be disposed in the array of gripping elements 612. The gripping elements 612 may be formed from a hard material, such as a metal. The spacers 614 may be formed from a hard material, such as a metal.

The plurality of gripping elements 612 and the plurality of spacers 614 may be disposed in a base 618. The base 618 may be fabricated from a material that has a predetermined elasticity. The elasticity of the base 618 provides flexibility to the gripping elements 612 to enable an even load distribution among the gripping elements 612 and/or along a length of each gripping element 612. The elasticity of the base 618 enables a full surface-to-surface contact between the gripping elements 612 and the object being handled particularly when the object being handled has irregular or uneven outer surface. In one embodiment, the base 618 may be an elastomer, for example a synthetic rubber, such as nitrile butadiene rubber (NBR). In another embodiment, the base 618 may be formed from a soft metal, such as aluminum.

In FIG. 6B, spacers 614 are disposed in every other interval between the neighboring gripping elements 612. Different arrangements and/or density of the spacers 614 may be used to achieve target stiffness of the insert 610. For example, the spacers 614 may be disposed in every interval between the gripping elements 612 to increase resistance to deflection. Fewer spacers 614 may be used to increase flexibility of the insert 610. In one embodiment, the spacers 614 may be connected to the gripping elements 612 to resist share forces. For example, the spacers 614 may be joined to the gripping elements 612 by welding, adhesives, or other suitable joining mechanisms.

Figure 7A:
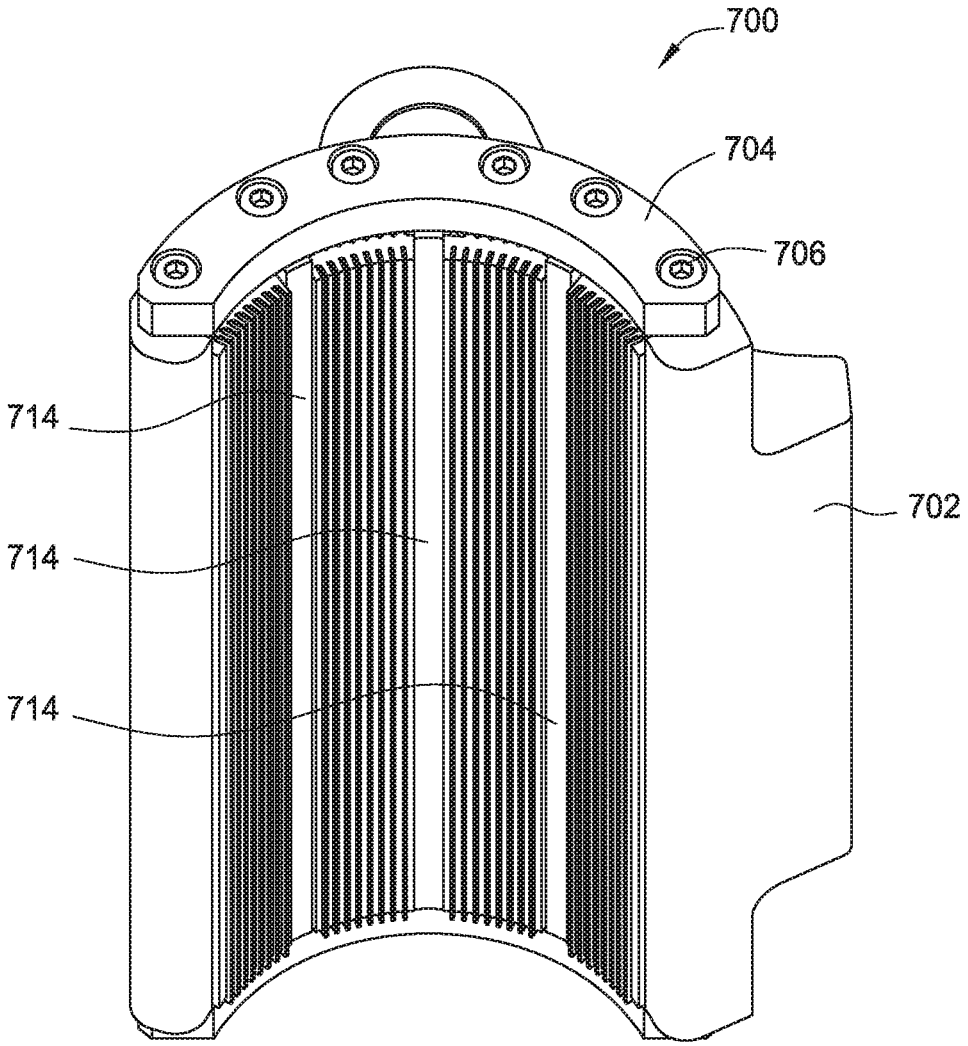
FIG. 7A is a schematic perspective view of a jaw according to one embodiment of the present disclosure.
Figure 7C:
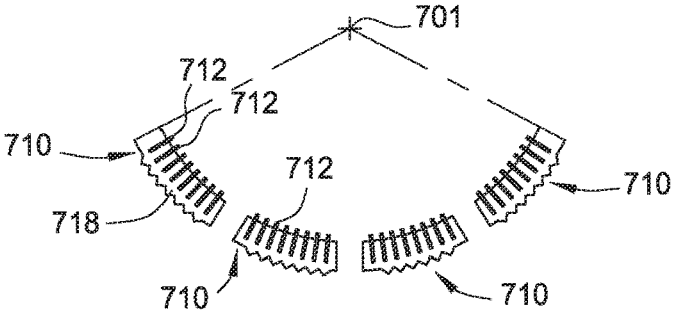
FIG. 7C is a schematic top view of the inserts of FIG. 7B.

FIG. 7A is a schematic perspective view of a jaw 700 according to one embodiment of the present disclosure. FIG. 7B is a schematic side view of inserts 710 in the jaw 700. FIG. 7C is a schematic top view of the inserts 710. The jaw 700 may be used as the jaws 110 in the gripping device 100.

The jaw 700 may include a frame body 702 and ends 704. The frame body 702 may include a plurality of dividers 714. The frame body 702, the dividers 714, and ends 704 form a plurality of cavities for receiving a plurality of insert 710 therein. In the embodiment of FIG. 7A, the plurality of dividers 714 are disposed along the entire length of the frame body 702 to form elongated cavities to receive elongated inserts. The frame body 702, the dividers 714, and the ends 704 may be made from a rigid material, such as a metal.

The inserts 710 may include a plurality of gripping elements 712 disposed in a base 718. The gripping element 712 may be a planar gripping element, similar to the gripping element 212. The plurality of inserts 710 may be disposed parallel to a longitudinal axis 701 so that the gripping elements 712 in the each insert 710 are disposed substantially parallel to the longitudinal axis 701.

The base 718, similar to the base 218, may be fabricated from a material that has a predetermined elasticity. The base 718 in each insert 710 may provide flexibility to the gripping elements 712 to enable an even load distribution among the gripping elements 712 and/or along a length of each gripping element 712. The elasticity of the base 718 enables a full surface-to-surface contact between the gripping elements 712 and the object being handled particularly when the object being handled has irregular or uneven outer surface. In one embodiment, the base 718 may be an elastomer, for example a synthetic rubber, such as nitrile butadiene rubber (NBR). In another embodiment, the base 718 may be formed from a soft metal, such as aluminum.

The dividers 714 may be formed from a material that provide rigidity to the assembly of the plurality of inserts 710. The dividers 714 may function as a frame or bracket to increase resistance to deflection.

Figure 7D:
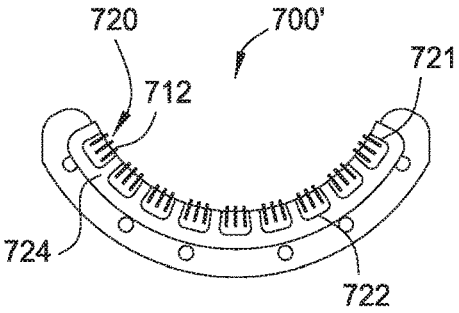
FIG. 7D is a schematic top view of an insert arrangement according to another embodiment of the present disclosure.
Figure 7B:
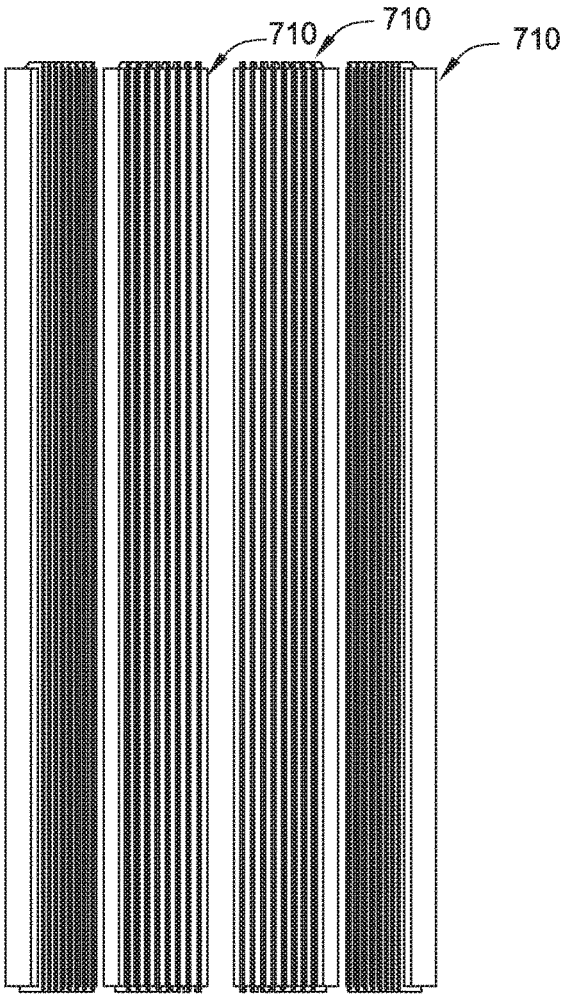
FIG. 7B is a schematic side view of inserts in the jaw of FIG. 7A.

FIG. 7D is a schematic top view of a jaw 700' according to another embodiment of the present disclosure. The jaw 700' is similar to the jaw 700 of FIGS. 7A-C except that the jaw 700' includes a plurality of inserts 720 that is narrower than the inserts 710. The jaw 700' includes a frame body 724 having a plurality of slots 726. Each slot 726 is shaped to receive one of the inserts 720. The frame body 724 may be made from a rigid material, such as a metal. The frame body 724 may be shaped to grip tubulars of a predetermined size.

Each insert 720 may include two or more gripping elements 712 disposed in a base 722. In one embodiment, each insert 720 may include three gripping elements. The base 722, similar to the base 218, may be fabricated from a material that has a predetermined elasticity. The base 722 in each insert 720 may provide flexibility to the gripping elements 712 to enable an even load distribution among the gripping elements 712 and/or along a length of each gripping element 712.

Because each the insert 720 only includes a few gripping elements 712, each insert 720 is narrower and may be arranged in frame bodies shaped to grip different sizes of tubulars.

Figure 8A:
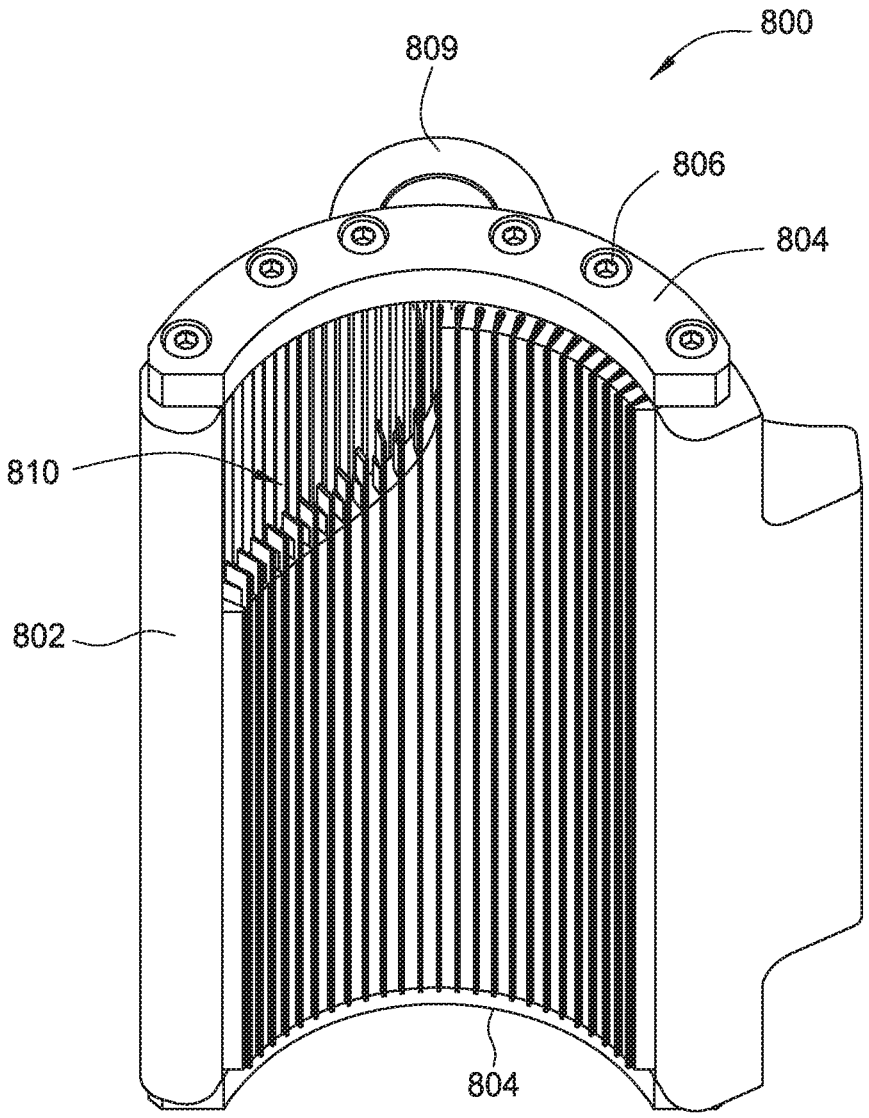
FIG. 8A is a schematic perspective view of a jaw according to one embodiment of the present disclosure.

FIG. 8A is a schematic perspective view of a jaw 800 according to one embodiment of the present disclosure. The jaw 800 may be used as the jaws 110 in the gripping device 100. The jaw 800 may include a frame body 802 and ends 804. The frame body 802 and ends 804 form a cavity for receiving an insert 810 therein. At least one end 804 may be movably attached to the frame body 802. The end 804 may be connected to the frame body 802 by connectors 806, such as screws. The end 804 may be removed from the frame body 802 to install or remove the insert 810 from the frame body 802. The frame body 802 and the ends 804 may be made from a rigid material, such as a metal. In one embodiment, the jaw 800 may include a handle 809 for connection with an actuator configured to move the jaw 800.

Figure 8C:
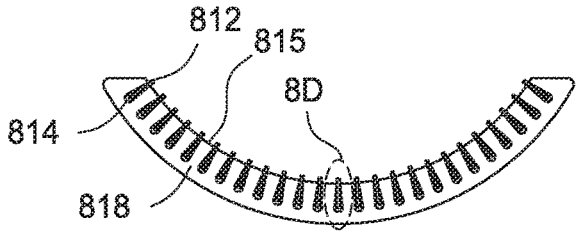
FIG. 8C is a schematic sectional view of the insert of FIG. 8A.
Figure 8D:
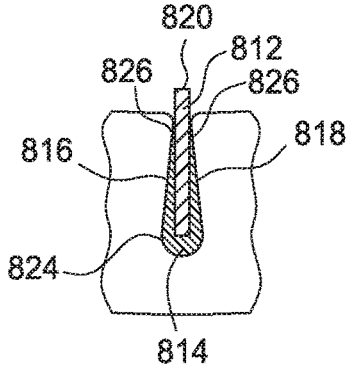
FIG. 8D is a partial enlarged sectional view of the insert of FIG. 8A.
Figure 8B:
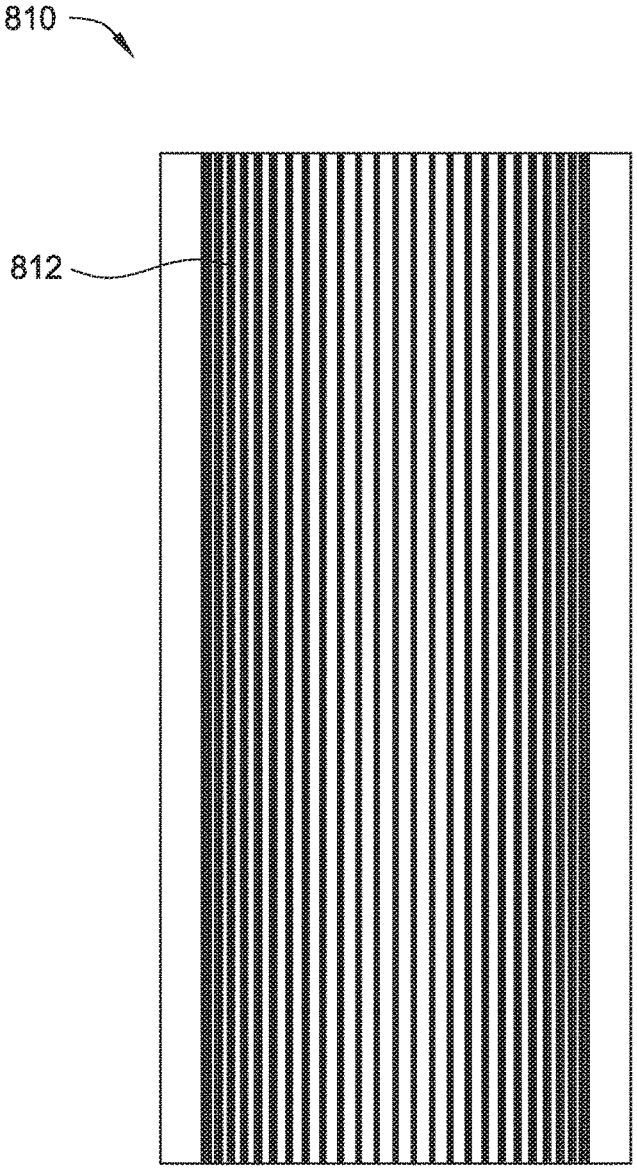
FIG. 8B is a schematic side view of insert in the jaw of FIG. 8A.

FIG. 8B is a schematic side view of the insert 810. FIG. 8C is a schematic sectional view of the insert 810. FIG. 8D is a partial enlarged sectional view of the insert 810. The insert 810 may include a base 818 having a plurality of slots 816 formed therein. The plurality of slots 816 may be parallel to an longitudinal axis of the base 818. Each slot 816 may be an elongated trench having a wider bottom 824 and a narrower entrance 826. A filling element 814 may be disposed at a lower portion of each slot 816. A gripping element 812 may be disposed in each slot 812. A lower portion 812*a* of the gripping element 812 may be surrounded by the filling element 814. An upper portion 812*b* of the gripping element 812 may be in contact with the base 816 at the entrance 826 of the slot 816.

As shown in FIG. 8C, the base 818 may be a section of a ring shaped plate having an inner curve 815. The inner curve 815 may be a section of a circle. The plurality of slots 816 may be arranged along the ring shaped plate at directions normal to the inner curve 815. In one embodiment, the plurality of slots 816 may be evenly distributed along the base 818. Alternatively, the plurality of slots 816 may be arranged at a varied pitch along the inner curve 815. The base 818 may be formed from a hard material, such as a metal. The base 818 hold the gripping elements 812 within the slots 816 to reduce deflection of the gripping elements 812 during operation, for example when a torque is applied to the gripping elements 812.

Each gripping element 812 may have a plurality of contact features 820 along a top edge for gripping an object. In one embodiment, the contact features 820 may be teeth. Alternatively, the contact features 820 may be grains or particles.

The base 818 may be formed from a hard material, such as a metal. The gripping elements 812 may be formed from a hard material, such as a metal. The filling element 814 may be formed from a material that has a predetermined elasticity. The elasticity of the filling material 814 allows movement of the gripping elements 812 at the lower portions 812*a* and enables the gripping elements 812 to pivot relative to the base 818 at the entrance 826 of the slot 814. Therefore, the elasticity of the filling elements 814 enables a full surface-to-surface contact between the gripping elements 812 and the object being handled particularly when the object being handled has irregular or uneven outer surface. In one embodiment, the filling elements 814 may be an elastomer, for example a synthetic rubber, such as nitrile butadiene rubber (NBR).

Even though, the slots 814 and the gripping elements 812 in the insert 810 are linear, non-linear slots, such as wavy slots, or combination of linear and nonlinear slots may be formed in the base 818 for supporting non-linear gripping elements or combination of linear and non-linear gripping elements.

Figure 9A:
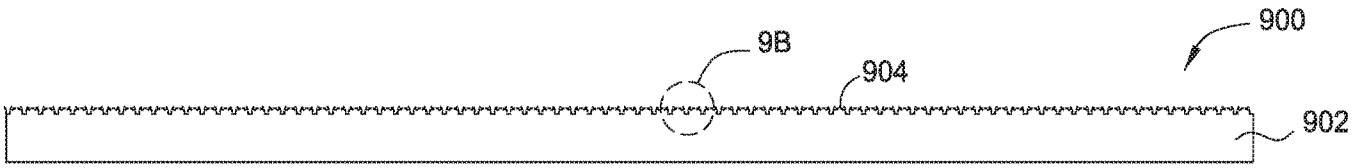
FIG. 9A is a schematic side view of a gripping element according to one embodiment of the present disclosure.
Figure 9B:
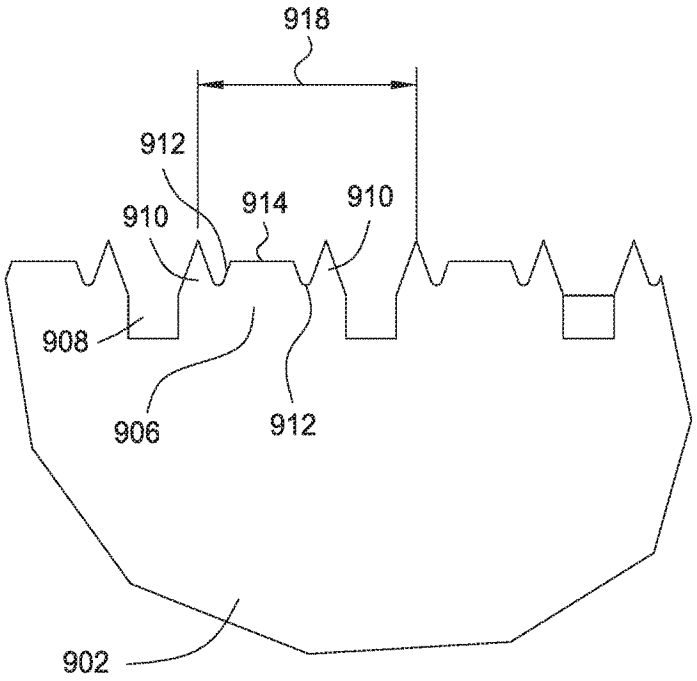
FIG. 9B is a partial enlarged view of the gripping element of FIG. 9A.

FIG. 9A is a schematic side view of a gripping element 900 according to one embodiment of the present disclosure. FIG. 9B is a partial enlarged view of the gripping element of FIG. 9A. The gripping element 900 may be used in place of any of the gripping elements 212, 312, 412, 512, 612, 712, and 812 above.

The gripping element 900 may include an elongated body 902. A plurality of contact features 906 may be formed on a blade edge 904 along the body 902. The contact features 906 may extend upward from the blade edge 904 for contacting an object being gripped. The plurality contact features 906 may be evenly distributed along the elongated body 902. A valley 908 may be formed between neighboring contact features 906. In one embodiment, a pitch 918 of the contact features 906 may be between about 2 mm to about 8 mm. For example, the pitch 918 of the contact features 906 may be about 4 mm. In one embodiment, the contact feature 906 may be wider than the valley 908. In one embodiment, a height difference between a bottom of the valley 908 and a tip of the contact feature 906 may be between about 0.5 mm to about 2 mm. For example, the height difference between the bottom of the valley 908 and the tip of the contact feature 906 may be about 1.5 mm.

In one embodiment, each contact feature 906 may be a tooth with a complex pattern to establish a target contact pattern. In the embodiment shown in FIG. 9B, each contact feature 906 includes two pointy teeth 910 and a flat portion 914 positioned between the two pointy teeth 910. Valleys 912 may separate the pointy teeth 910 and the flat portion 914. Each pointy tooth 912 may have an angel 920 to establish a point contact. In one embodiment, the angel 920 on each pointy tooth 912 may be about 40 degrees. The flat portion 914 may include a substantial planar upper surface. In one embodiment, the contact feature 906 may be symmetrical about a central line 916 of the contact feature 906. Particularly, the pointy teeth 910 in each contact feature 906 are symmetrical about the central line 916. In one embodiment, the flat portion 914 may have a planar upper surface of about 1.2 mm long. The pointy teeth 910 may be higher than the flat portion 914. In one embodiment, the pointy teeth 910 may be higher than the flat portion 914 by about 0.4 mm.

Compared with traditional tooth patterns, the contact feature 906 provides reduced penetration depth because penetration depth is limited to the height of the pointy teeth 910 over the flat portion 914. The lower height of the teeth 910 also makes the penetration depth more independent from the material of the object and/or the torque applied to the object. Furthermore, because the contact feature 906 is symmetrical (the two pointy teeth 910 is symmetrical about the central line 916), the gripping element 900 may be easily arranged. Additionally, the spaces, such as the flat portion 914 and the valleys 908, 912, enable easily cleaning of the gripping element 900. The valleys 908, 912 also provide space of material built up, thus preventing clogging.

Alternatively, other patterns may be used in the contact features 906 to achieve a target contact with the object.

Figure 10A:
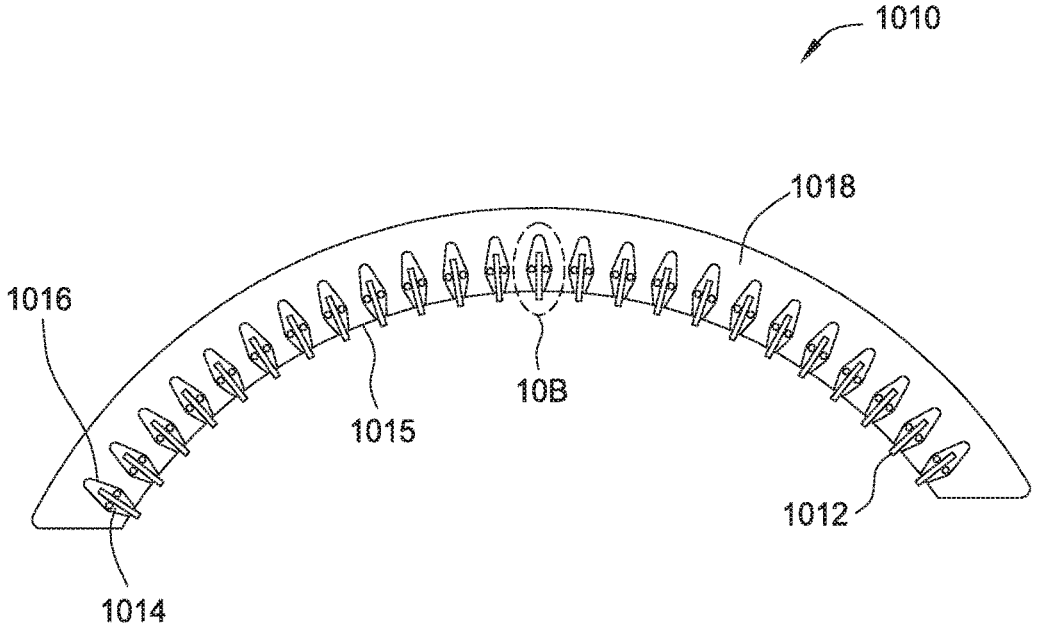
FIG. 10A is a schematic sectional view of an insert according to one embodiment of the present disclosure.
Figure 10B:
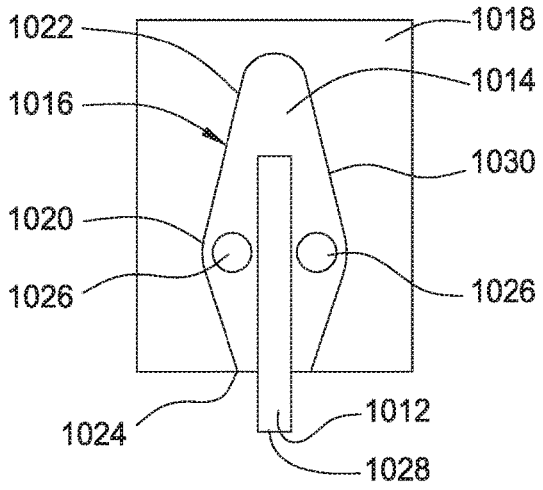
FIG. 10B is a partial enlarged view of the insert of FIG. 10A.

FIG. 10A is a schematic sectional view of an insert 1010 according to one embodiment of the present disclosure. FIG. 10B is a partial enlarged view of the insert 1010. The insert 1010 may be inserted in a frame body, such as the frame body 802 to form a jaw used in a gripping device, such as the gripping device 100.

The insert 1010 may include a base 1018 having a plurality of slots 1016 formed therein. The plurality of slots 1016 may be parallel to a longitudinal axis of the insert 1010. A gripping element 1012 may be disposed in each slot 1016. Filling element 1014 may be disposed surrounding a lower portion of the gripping element 1012. In one embodiment, the filing element 1014 may have one or more air cell 1026 formed therein.

The base 1018 may be a section of a ring shaped plate having an inner curve 1015. The inner curve 1015 may be a section of a circle. The plurality of slots 1016 may be arranged along the ring shaped plate at directions normal to the inner curve 1015. In one embodiment, the plurality of slots 1016 may be evenly distributed along the base 1018. Alternatively, the plurality of slots 1016 may be arranged at a varied pitch along the inner curve 1015. The base 1018 may be formed from a hard material, such as a metal. The base 1018 holds the gripping elements 1012 within the slots 1016 to reduce deflection of the gripping elements 1012 during operation, for example when a torque is applied to the gripping elements 1012.

Each gripping element 1012 may have a plurality of contact features 1028 along a top edge for gripping an object. In one embodiment, the contact features 1028 may be teeth. Alternatively, the contact features 1028 may be grains or particles.

Each slot 1016 may be an elongated trench having a middle section 1020, a bottom section 1022, and an entrance 1024. In one embodiment, the middle section 1020 may be wider than other portions of the slot 1016. For example, as shown in FIG. 10B, the slot 1016 may have a wider middle section 1020, a narrower bottom 1022, and a narrower entrance 1024. In FIG. 10B, the cross section of the slot 1016 is substantially diamond shaped. Alternatively, the cross section of the slot 1016 may be oval shaped.

The filling element 1014 may be formed from a material that has a predetermined elasticity. In one embodiment, the filling elements 1014 may be formed from elastic material, for example, a foam material, such as polyurethane.

The filling element 1014 fills the slot 1016 between the gripping element 1012 and walls of the slot 1016. In one embodiment, two air cells 1026 may be formed in the filling element 1014. The air cells 1026 may be positioned in the wide middle section 1020 of the slot 1016 and on opposite sides of the gripping element 1012. The air cells 1016 may be formed from by inserting place holders, such as solid tubes, along the length of the filling element 1014 when forming the filling element 1014 and then removing the place holders from the filing element 1014. Alternatively, air cells 1026 may be replaced by an elastic material that has more elasticity than the filling element 1014.

The elasticity of the filling material 1014 allows movement of the gripping elements 1012 in the slot 1016. The air cells 1026 bring in compressibility to the structure and enable the gripping elements 1012 to move more easily. The air cells 1026 near the middle section 1020 of the slot 1016 effectively enables pivoting of the gripping element 1012 about the entrance 1024 without making direct contact between the gripping element 1012 and the rigid base 1018.

In one embodiment, an optional bonding layer 1030 may be used to bond the filling element 1014 to walls of the slot 1016. The bonding layer 1030 may be an adhesive primer.

Figure 11:
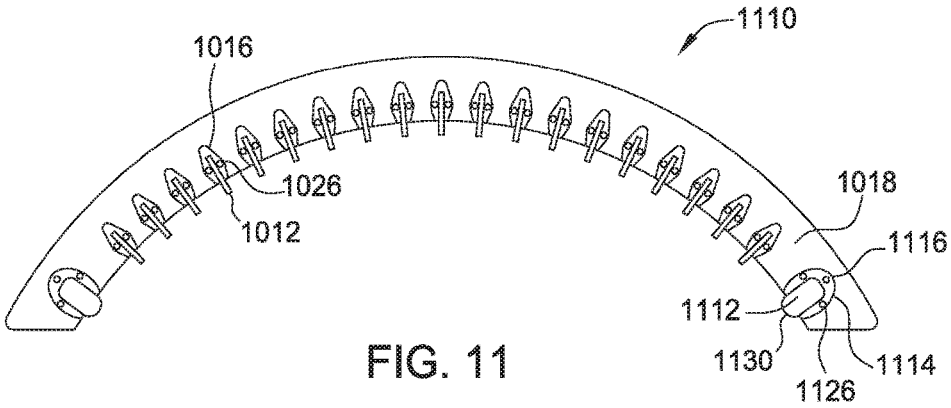
FIG. 11 is a schematic sectional view of an insert according to another embodiment of the present disclosure.

FIG. 11 is a schematic sectional view of an insert 1110 according to another embodiment of the present disclosure. The insert 1110 is similar to the insert 1010 of FIG. 10A except that the insert 1110 includes rigid bars 1112 in place of the outer most gripping elements 1012. The insert 1110 may include a base 1118 having a plurality of slots 1016 for receiving the gripping elements 1012 and the filling element 1014.

The base 1018 may further include two bar slots 1116 formed on two ends. Each bar slot 1116 may have a cross section of an oval shape. Filling element 1114 may be disposed in the bar slot 1116 around the bar 1112. In one embodiment, one or more air cells 1126 may be formed in the filling element 1114. In one embodiment, three air cells 1126 may be formed in the filling element 1114. One air cell 1126 may be positioned near a bottom of the bar 1112 and two air cells 1126 may be positioned near two sides of the bar 1112.

The bars 1112 may be a solid metal bar, such as a solid steel bar. In one embodiment, the bar 1112 may have a thickness of about 4 mm. In one embodiment, the bar 1112 may have a smooth top surface 1130 to establish a line contact with the tubular being gripped.

When used to gripping a tubular, the solid bars 1112 establish line contact with the tubular and functions as a guiding feature to align the insert 1110 with the tubular before transferring any torque without damaging the gripping elements 1012.

Figure 12:
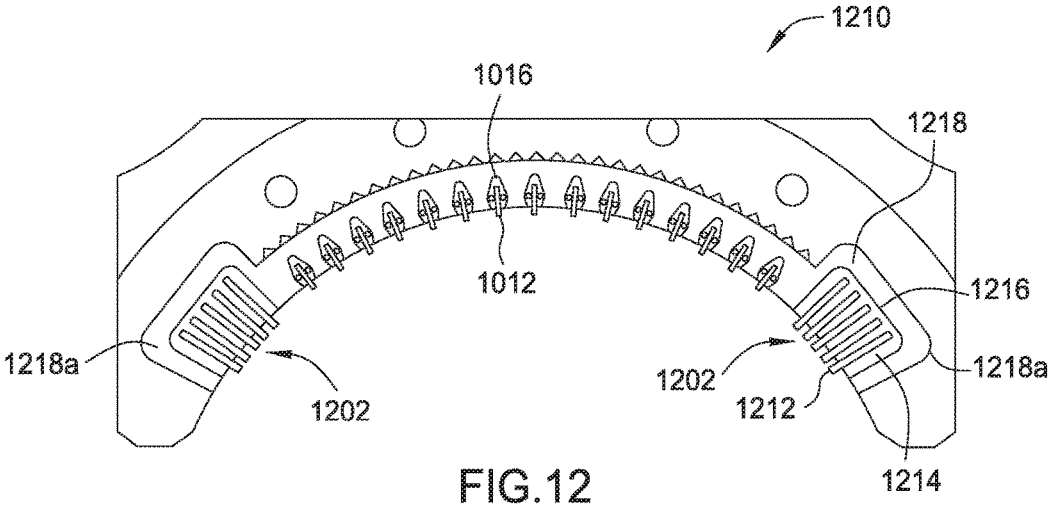
FIG. 12 is a schematic sectional view of an insert according to another embodiment of the present disclosure.

FIG. 12 is a schematic sectional view of an insert 1210 according to another embodiment of the present disclosure. The insert 1210 is similar to the insert 1110 except that the insert 1210 includes blade segments 1202 in place of the bars 1112. The insert 1210 may include a base 1218 having a plurality of slots 1016 for receiving the gripping elements 1012 and the filling element 1014.

The base 1218 may further include two slots 1216 formed on two ends for receiving the blade segments 1202. Each blade segment 1202 may include two or more side blades 1212 disposed in a filing element 1214. The side blades 1212 may be disposed parallel to a longitudinal axis of the base 1218. The side blades 1212 may be thicker and/or wider than the gripping elements 1012. In one embodiment, the base 1218 may include thicker end portions 1218*a* to receive the wider side blades 1212. In one embodiment, the side blades 1212 may be about 1.6 mm in thickness. The side blades 1212 may have a width of about 15 mm.

The thicker and/or wider blades 1212 in the blade segments 1202 are configured to handle the torsional loads distributed at outer edges of the insert 1210 without sustaining mechanical damages.

Figure 13:
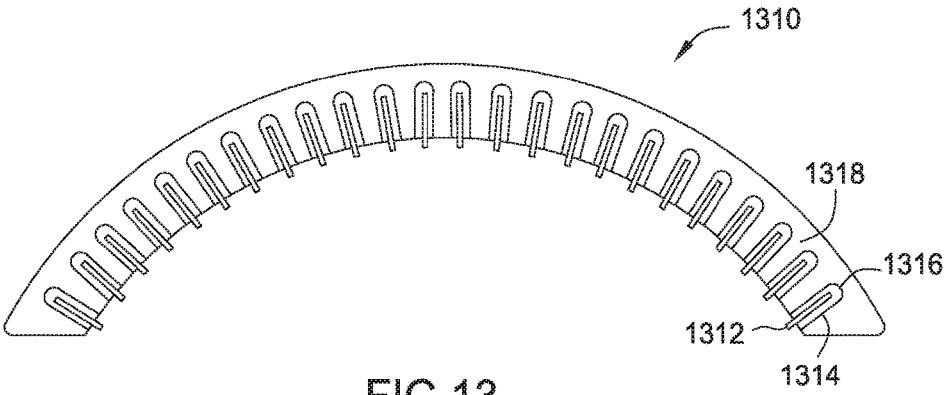
FIG. 13 is a schematic sectional view of an insert according to one embodiment of the present disclosure.

FIG. 13 is a schematic sectional view of an insert 1310 according to one embodiment of the present disclosure. The insert 1310 is similar to the insert 1010 except that the insert 1310 includes slots of a different shape.

The insert 1310 may include a base 1318 having a plurality of slots 1316 formed therein. The plurality of slots 1316 may be parallel to a longitudinal axis 1301. A gripping element 1312 may be disposed in each slot 1316. Filling element 1314 may be disposed surrounding a lower portion of the gripping element 1312. Each slot 1316 may be an elongated trench having uniform width with straight side walls. The slots 1316 are easier to machine compared to slots of other shapes.

Embodiments of the present disclosure provide an insert for a tubular handling tool. The insert includes a gripping element having an elongated body and a plurality of contact features, a first member formed from a hard material, wherein the first member contacts the gripping element in one or more locations, and a second member formed from an elastic material, wherein the second member contacts the gripping element along the elongated body.

In one or more embodiment, the first member is a bracket having a slot formed therethrough, and the gripping member is disposed in the slot, and the second member is a base, wherein the gripping member and the bracket are disposed in the base.

In one or more embodiment, the insert further includes a plurality of gripping members arranged parallel to a longitudinal axis, the bracket includes a plurality of slots, wherein each gripping member is disposed in a corresponding slot in the bracket.

In one or more embodiment, the gripping member has a planar body, the first member is a non-planar gripping member formed to contact the elongated body of the gripping member at one or more locations, and the second member is a base, wherein the gripping member and the non-planar gripping member are disposed in the base.

In one or more embodiment, the insert further includes a third member formed from a hard material, wherein the second member contacts the gripping element in one or more locations, the third member is a non-linear gripping member, the first and third members are disposed on opposite sides of the gripping member, and the third member is disposed in the base.

In one or more embodiment, the first member and the third member are disposed in mirror image on opposite sides of the gripping member.

In one or more embodiment, the insert further includes a plurality of planar gripping elements disposed parallel to a longitudinal axis and a plurality of first elements, wherein the first element is disposed between neighboring planar gripping elements and in contact in both neighboring planar elements.

In one or more embodiment, the insert further includes a plurality of gripping element disposed parallel to a longitudinal axis, wherein the first member is a spacer disposed between a section of an interval between neighboring gripping elements, and the second member is a base, wherein the plurality of gripping members and the spacers are disposed in the base.

In one or more embodiment, the first member is a base having a slot, the second member is a filling element disposed in a bottom portion of the slot, and gripping member is disposed in the slot.

In one or more embodiment, the slot is an elongated trench having a wider bottom portion and a narrower entrance, and the gripping member contacts the base at the entrance of the elongated trench.

In one or more embodiment, the slot is an elongated trench having a wider and a narrower entrance.

In one or more embodiment, the filling element having one or more air cells formed therein.

In one or more embodiment, the base further has a side slot for receiving a thicker blade or a blade segment.

Embodiments of the present disclosure provide an insert for a tubular handling tool. The insert includes a base, a plurality of linear gripping elements disposed in the base, wherein each linear gripping element has an elongated body having a linear edge, the linear edge protrudes from the base, and a plurality of contact features are formed on the linear edge, and a support assembly disposed in the base, wherein the support assembly contacts at least one of the plurality of the linear gripping element.

In one or more embodiment, the support assembly comprises one or more brackets disposed in the base, each of the one or more brackets has a plurality of slots for receiving the elongated bodies of the plurality of gripping elements.

In one or more embodiment, the base is formed from an elastic material and the one or more brackets are formed from a rigid material.

In one or more embodiment, the support assembly comprises a plurality of wavy gripping elements, each wavy gripping element is disposed between two neighboring linear gripping elements and is in contact in multiple points with the linear gripping elements.

In one or more embodiment, the base is formed from a rigid material, a plurality of slots formed therein for receiving the plurality of linear gripping elements, the support assembly comprises a plurality of filling elements disposed in the slots, the filling elements are formed from an elastic material.

In one or more embodiment, each of the plurality of slot has a cross section of a middle section that is wider than an entrance.

In one or more embodiment, each filling element includes one or more air cells formed near the middle section of the slot.

In one or more embodiment, the base further includes two side slots, the plurality of slots are formed between the two side slots, and the side slots are shaped to receive a thicker blade or a blade segment.

In one or more embodiment, the support assembly comprises a plurality of supporting blocks disposed between neighboring linear gripping elements.

In one or more embodiment, each of the contact features is symmetrical about a central line of the contact feature.

Embodiments of the present disclosure provide a gripping element. The gripping element includes an elongated body having a blade edge, wherein the blade edge includes a plurality of contact features, wherein each contact feature is symmetrical about a central line of the contact feature, and a plurality of valleys, wherein a valley is disposed between neighboring contact features.

In one or more embodiment, the elongated body is linear.

In one or more embodiment, the elongated body is wavy.

While the foregoing is directed to embodiments of the present disclosure, other and further embodiments may be devised without departing from the basic scope thereof, and the scope thereof is determined by the claims that follow.

The invention claimed is:

1. An insert for a tubular handling tool, comprising:

a gripping element having an elongated body and a plurality of contact features;

a first member formed from a hard material and having a plurality of slots formed therein, wherein the first member supports the gripping element in one or more locations and the gripping element is disposed in one of the plurality of slots; and a second member formed from an elastic material, wherein the second member contacts the gripping element along the elongated body, wherein the first member is a base having the plurality of slots and the second member is a filling element disposed in a bottom portion of one of the plurality of slots, and the filling element has one or more air cells formed therein.

2. The insert of claim 1, wherein each of the plurality of slots is an elongated trench having a middle wider than an entrance.

3. The insert of claim 1, wherein the base further has a side slot for receiving a thicker blade or a blade segment.

4. The insert of claim 1, wherein at least one gripping element is disposed in each of the plurality of slots.

5. An insert for a tubular handling tool, comprising:

a base having a plurality of slots formed therein;

a plurality of linear gripping elements disposed in the base, wherein each of the plurality of slots receives at least one of the plurality of linear gripping elements, each linear gripping element has an elongated body having a linear edge, the linear edge protrudes from the base, and a plurality of contact features are formed on the linear edge; and a support assembly disposed in the base, wherein the support assembly contacts at least one of the plurality of the linear gripping element, wherein the base is formed from a rigid material, the support assembly comprises a plurality of filling elements disposed in the slots, the filling elements are formed from an elastic material, and each filling element includes one or more air cells formed near a middle section of the slot.

6. The insert of claim 5, wherein the support assembly comprises a plurality of supporting blocks disposed between neighboring linear gripping elements.

7. The insert of claim 5, wherein the base is formed from a rigid material.

* * * * *